US006763558B1

(12) United States Patent
Mytych

(10) Patent No.: US 6,763,558 B1
(45) Date of Patent: Jul. 20, 2004

(54) VEHICLE SHAPED CASKETS AND URNS

(76) Inventor: Clinton R. Mytych, 3714 Raintree Ct., Wixom, MI (US) 48393

( * ) Notice: Subject to any disclaimer, the term of this patent is extended or adjusted under 35 U.S.C. 154(b) by 0 days.

(21) Appl. No.: 10/411,694

(22) Filed: Apr. 11, 2003

(51) Int. Cl.[7] ..... A61G 17/00
(52) U.S. Cl. ..... 27/2; 27/1; 27/14; 27/27
(58) Field of Search ..... 27/1, 2, 27, 35, 27/14, 8; D99/2, 3, 5; 211/85.16; 52/133

(56) References Cited

U.S. PATENT DOCUMENTS

| | | | | | |
|---|---|---|---|---|---|
| 321,781 | A | * | 7/1885 | Barrett | 248/439 |
| 937,086 | A | * | 10/1909 | Montross | 27/27 |
| 1,292,268 | A | * | 1/1919 | De Camp | 27/27 |
| 1,492,998 | A | * | 5/1924 | Meeker | 27/27 |
| 4,017,947 | A | * | 4/1977 | Acton | 27/27 |
| 4,372,018 | A | * | 2/1983 | Miller et al. | 27/35 |
| 4,730,370 | A | * | 3/1988 | Elder | 27/4 |
| 5,586,376 | A | * | 12/1996 | Enneking et al. | 27/27 |
| 5,619,785 | A | | 4/1997 | Tambussi | |
| D417,058 | S | | 11/1999 | Royal et al. | |
| D441,171 | S | | 4/2001 | Vergakis | |
| 6,370,744 | B1 | | 4/2002 | Mendez | |

FOREIGN PATENT DOCUMENTS

| | | | |
|---|---|---|---|
| JP | 10-146367 | * | 6/1998 |

* cited by examiner

*Primary Examiner*—William L. Miller
(74) *Attorney, Agent, or Firm*—Richard C. Litman

(57) ABSTRACT

The vehicle shaped caskets and urns are stylized funeral containers that are configured to reflect the particular features of specific automobiles. The funeral containers include a body portion, a lid portion and a mounting base member. The body portion reflects the features of the lower chassis that are particular to specific automobiles, including headlights, bumpers, fenders and doors. The lid portion reflects the features that are particular to top portion of specific vehicles, including a windshield, a trunk, and windows. The caskets include authentic nameplates and hood ornaments to enhance their authenticity.

5 Claims, 3 Drawing Sheets

VEHICLE SHAPED CASKETS AND URNS

BACKGROUND OF THE INVENTION

1. Field of the Invention

The present invention relates to funeral caskets and urns, and more particularly to caskets and urns that are formed to reflect world-renowned automobiles.

2. Description of the Related Art

Customized funeral services are becoming increasingly popular today. Funeral services now feature items and novelties that are meaningful commemorations of the decedent's life. Many family members include photos or other displays of the deceased partaking in their favorite hobbies and pastimes. Also, many people include some of the deceased's favorite heirlooms and keepsakes in the casket with the deceased when they are buried. Many people are comforted by the fact that when they die they will be able to take some of their favorite items with them, and that their funeral services will truly reflect their personality.

Depending on the hobbies and interests of the deceased it may often be difficult to include the deceased's keepsakes as part of the funeral service. Many people are very passionate about their automobiles. Some people will care for an automobile and retain ownership of a special car for most of their life. It is impossible, however, to have the automobile present in the funeral home or in the casket with the deceased. It would be desirable for many people to have passion or affection for automobiles, or particular models of automobiles, remembered in their funeral services to truly reflect their personality.

The following patent documents disclose examples of caskets and other articles that have been designed to reflect people's passion for automobiles.

U.S. Design Pat. No. 417,058, issued to Royal et al., discloses the ornamental design of a mailbox shaped like an automobile. The body of the mailbox is the form of a racecar and the hood of the racecar is opened to receive and retain mail.

U.S. Design Pat. No. 441,171, issued to Vergakis, discloses an ornamental design of an automobile shaped mailbox. This design provides a bottom base portion and top portion that is shaped like a racecar. The bottom portion includes a door that opens to receive mail into the bottom portion of the mailbox.

U.S. Pat. No. 5,619,785 issued to Tambussi discloses a method of making a metal casket. The metal casket includes a main body compartment and a lid component. A pair of handles is disposed on either side of the main body component. The lid releasable fits on top of the main body component so the lid may be removed to allow access to the interior of the casket.

U.S. Pat. No. 6,370,744 issued to Mendez discloses a car shaped coffin. The coffin is formed as a stylized, generic automobile. The coffin includes a base unit, which represents the chassis of a generic automobile. The coffin also includes a lid portion that represents the top portion, including windows and a roof, of a generic automobile. The coffin further includes all of the common features of an automobile including doors, fenders, bumpers, and a license plate.

People who are interested in automobiles are typically attached to very specific automobiles. These people would not want their remains to be stored in a casket or urn depicting an automobile unless it depicted the exact automobile that they were particularly passionate about.

Therefore, what is needed is caskets and urns that are designed to reflect classic and world-renowned automobiles. What is further needed is caskets and urns that feature the very lines, curves and recognizable styling of specific automobiles themselves. What is still further needed are caskets and urns that may feature authentic nameplates and hood ornaments of the particular vehicles to enhance the authentic look of the caskets and urns.

None of the above inventions and patents, taken either singly or in combination, is seen to describe the instant invention as claimed. Thus vehicle shaped caskets and urns solving the aforementioned problems are desired.

SUMMARY OF THE INVENTION

The vehicle shaped caskets and urns of the present invention are stylized funeral containers that are configured to reflect the particular features of specific automobiles. The funeral containers include a body portion, a lid portion and a mounting base member. The body portion reflects the features of the lower chassis that are particular to specific automobiles, including headlights, bumpers, fenders and doors. The lid portion reflects the features that are particular to the top portion of specific vehicles, including a windshield, a trunk, and windows. The lid portion is connected to the body portion by a plurality of hinges and comprises a hood section and a roof section. The mounting base portion is positioned underneath the body portion to provide support for the funeral container.

An interior body retaining compartment is located inside of the body portion of the casket. The lid portion of the casket is lifted to allow access to the body retaining compartment. The lid portion has a lifting lip that is positioned along the contacting surfaces of the lid portion and the body portion of the casket. The lifting lip allows someone to separate the lid portion from the body portion. The lid portion pivots open about a plurality of hinges that connect the lid portion to the body portion. The casket is designed so that either the entire lid portion can be opened or either the hood section or the roof section of the lid portion may be opened separately. To place the deceased into the casket it is necessary to open the entire lid portion. For viewing the deceased during the funeral services only one section of the lid portion needs to be opened.

A plurality of authentic identification members are located on the base member and the body portion of the casket to enhance the authenticity of the caskets. The authentic identification members contain features that are particular to individual automobiles and help reflect the actual appearance of the automobile. Particularly, the caskets include nameplates and authentic hood ornaments that appear on the actual automobiles.

Accordingly, it is a principal object of the invention to provide caskets and urns that are designed to reflect classic and world renowned automobiles It is another object of the invention to provide caskets and urns that feature the very lines, curves and recognizable styling of specific automobiles themselves.

It is a further object of the invention to provide caskets land urns that may feature authentic nameplates and hood ornaments of the particular vehicles to enhance the authentic look of the caskets and urns.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a stylized funeral container that is configured to reflect the particular features of specific automobiles. The funeral container may be designed to reflect the authentic features of any vehicle that is desired by the deceased. The funeral container may be made into a casket for holding the body of the deceased, or a smaller urn for holding the ashes of the deceased.

Figure 1:
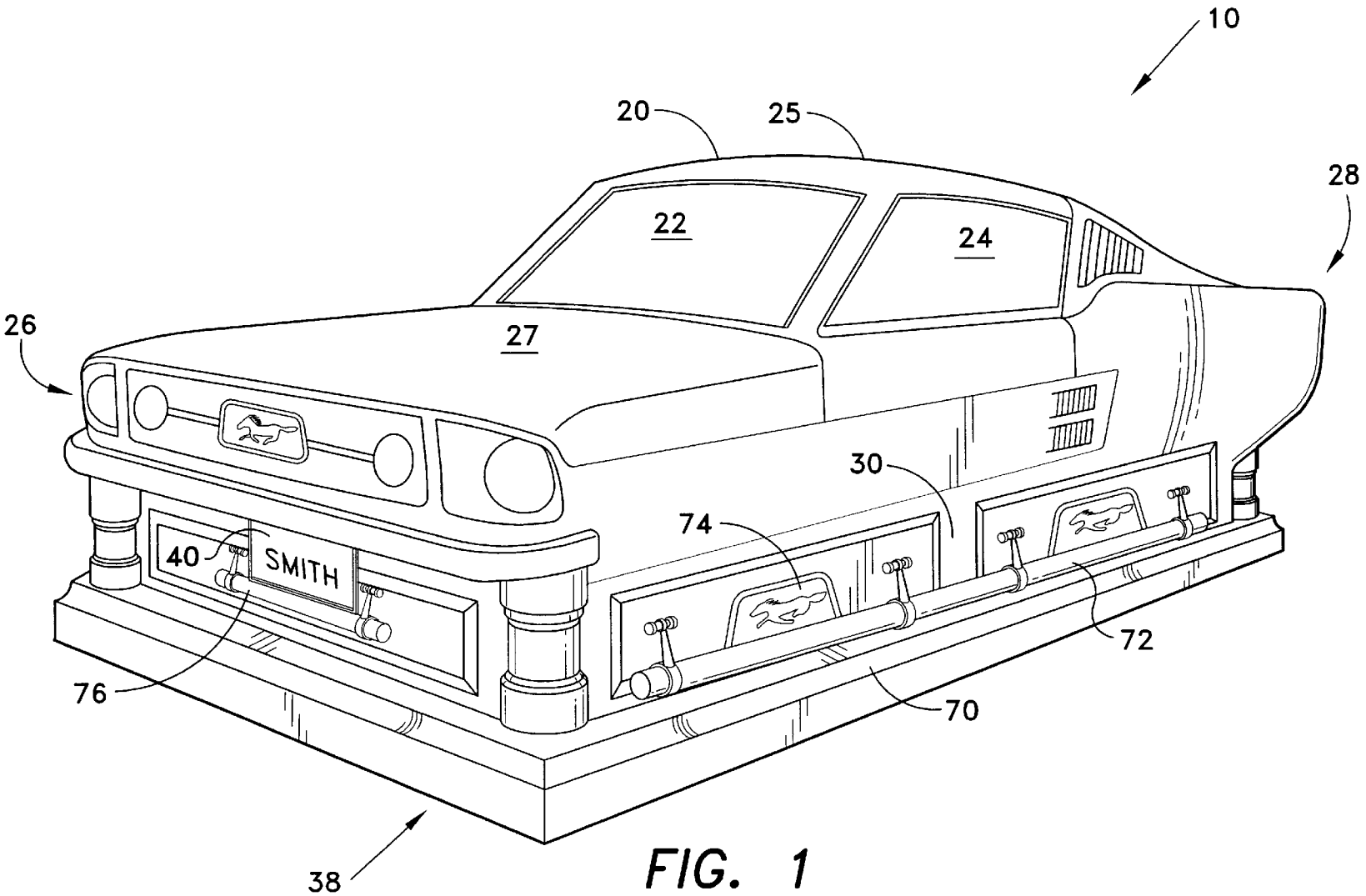
FIG. 1 is a perspective view of a vehicle shaped casket according to the present invention.
Figure 2:
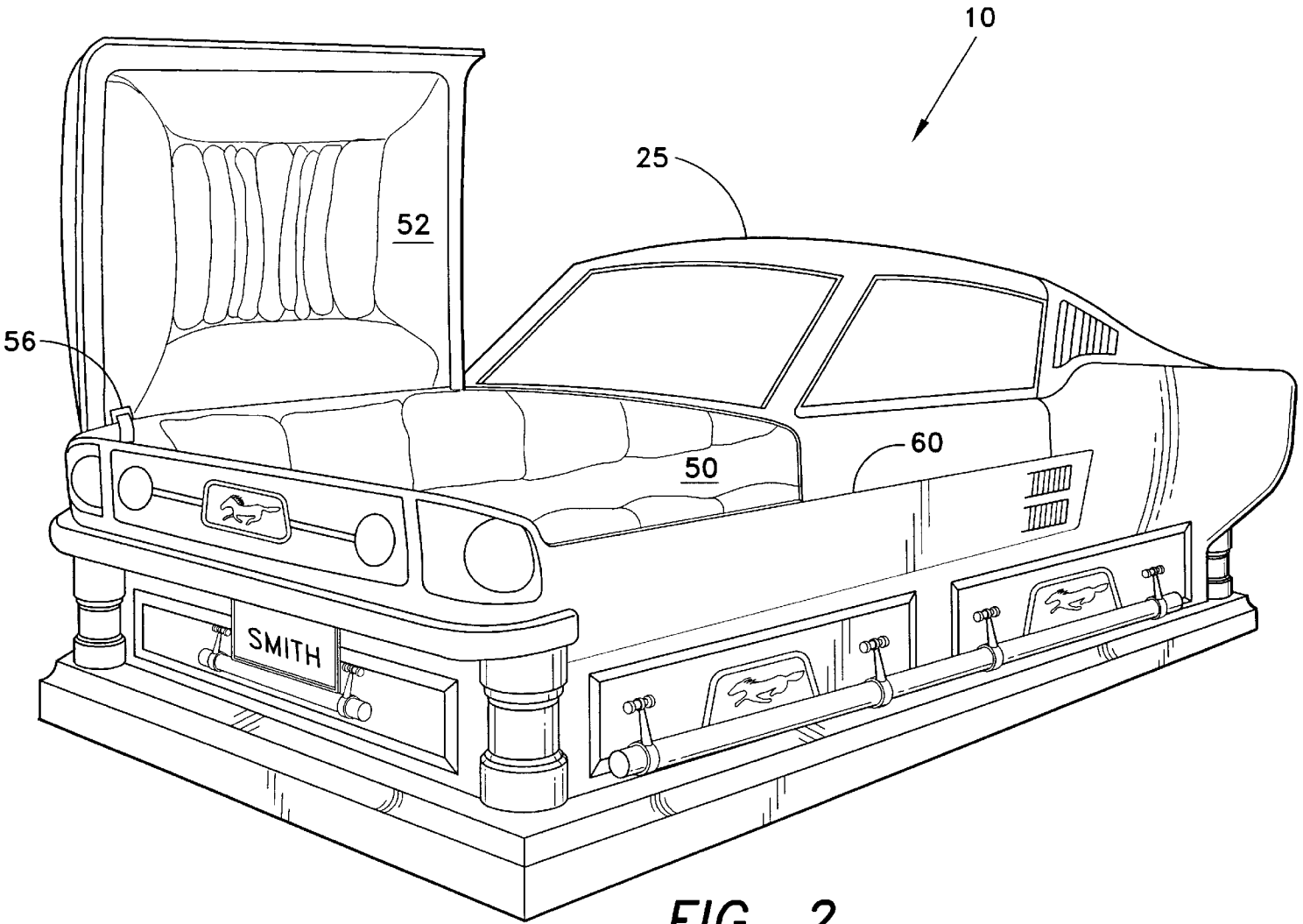
FIG. 2 is perspective view of a vehicle shaped casket in a first open position.
Figure 3:
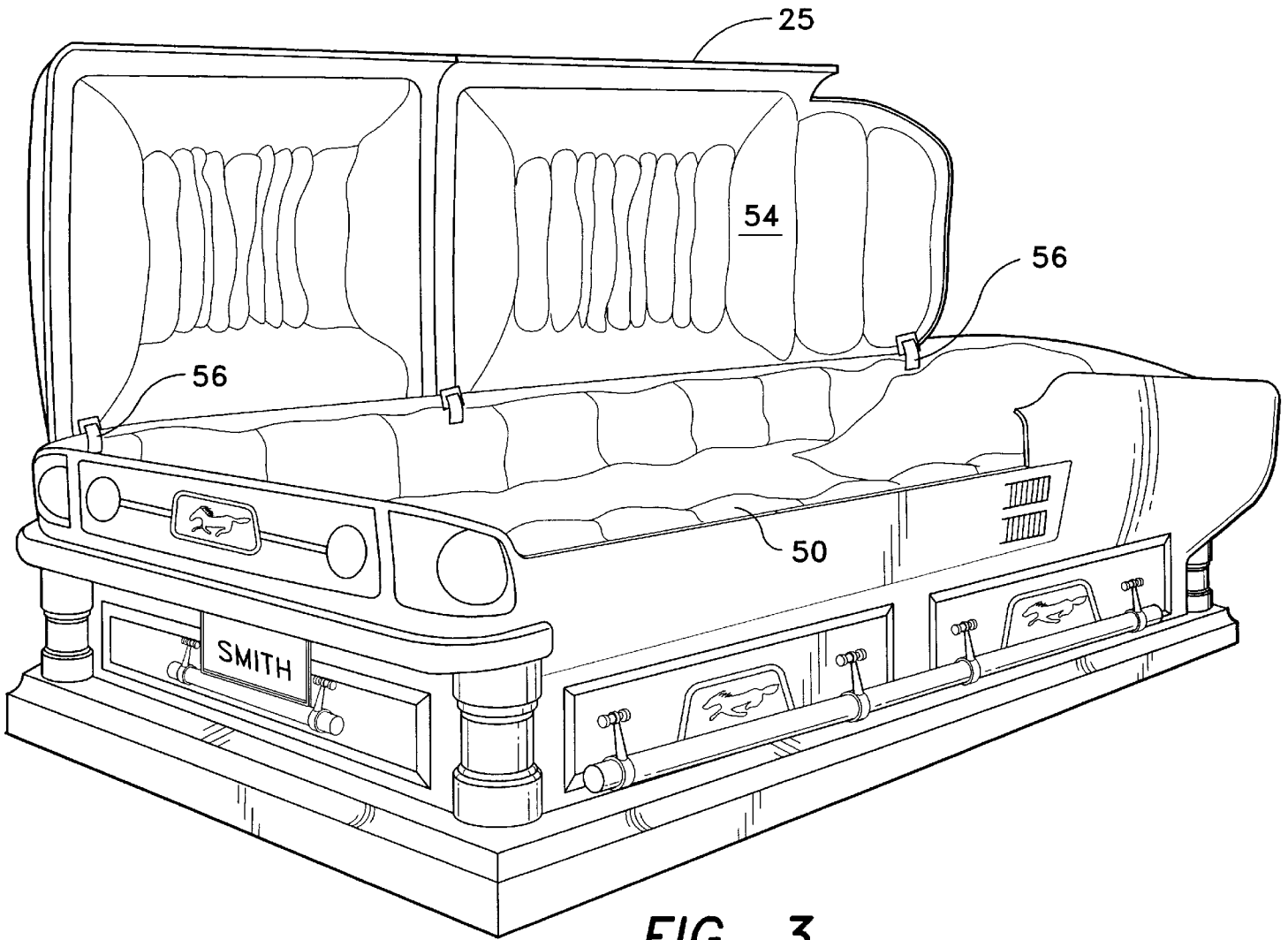
FIG. 3 is a perspective view of a vehicle shaped casket in a second open position.

FIGS. 1–3 depict varying views of a vehicle shaped casket 10 according to the present invention. The vehicle shaped urns contain the same authentic features as the caskets but on a smaller scale. Discussion of FIGS. 1–3 will specifically pertain to the caskets but can be applied to the urns as well.

FIG. 1 is an environmental, perspective view of a preferred embodiment of the vehicle shaped casket 10. The vehicle shaped casket 10 comprises a lid portion 20, a body portion 30 and a mounting base member 70. The body portion 30 reflects the authentic features of particular classic and world renowned automobiles. The body portion 30 includes a front bumper 26, a rear bumper 28, fenders, doors and headlights. All of these features are designed to reflect the appearance of the particular automobile that is represented by the casket.

The lid portion 20 of the vehicle shaped casket 10 authentically reflects the top portion of the particular automobile. The lid portion 20 further comprises a hood section 27 and a roof section 25. The lid portion 20 displays authentic features of the particular vehicles including a windshield 22, windows 24, a hood 27, a roof 25 and a trunk (not shown). The lid portion 20 is pivotally connected to the body portion 30 by a plurality of hinge members 56 (shown in FIGS. 2 and 3).

The mounting base member 70 is positioned underneath the body portion 30 of the vehicle shaped casket 10. The mounting base portion 70 provides support for the vehicle shaped casket 10. The mounting base portion 70 further comprises a message display 40 disposed on the front of the base member 70 directly below the front bumper portion 26. The message display 40 may present the name of the deceased or any other message desired by the deceased or the family of the deceased. The message display 40 is preferably in the form of a personalized license plate.

The base portion 70 further comprises a plurality of gripping rails. Front and rear gripping rails 76 are positioned on the front and rear surfaces of the base member 70. Side gripping rails 72 are positioned on both sides of the base member 70. The gripping rails 72,76 allow pallbearers to lift and transport the vehicle shaped casket 10 during the funeral services.

A plurality of authentic automobile identification displays 74 (depicted diagrammatically in the drawings) are disposed on the base member 70 and body portion of the casket. The identification displays 74 comprise specific emblems or ornaments from the actual automobile reflected by the vehicle shaped casket 10. The identification displays 74 enhance the authentic representation of the particular automobile. The identification displays 74 are preferably authentic name or logo plates and hood ornaments that are found on the actual automobiles.

FIG. 2 depicts a perspective view of the vehicle shaped casket 10 in a first open position. The vehicle shaped casket 10 further comprises a body retaining compartment 50 positioned inside of the body portion 20. The body retaining compartment 50 is adapted for holding the body of the deceased. The lid portion 20 may be opened to place the body into the casket 10 and to view the body during the funeral services.

The lid portion 20 includes a lifting lip 60, which is disposed along the contacting surfaces of the lid portion 20 and the body portion 30. The lifting lip 60 allows the lid portion 20 to be separated from the body portion 20 to allow access to the body retaining compartment 50. The lid portion 20 pivots about the hinge members 56 from the closed to the open position. Each section of the lid portion 20 may be opened individually or simultaneously. In FIG. 2 the hood section 27 of the lid portion 20 is opened by itself. The hood section 27 is lifted by itself when the body of the deceased is being viewed during the funeral services.

FIG. 3 depicts the vehicle shaped casket 10 in a second open position. In FIG. 3 the hood section 25 and the roof section 27 of the lid portion 20 are in the open position. It is necessary to lift open the entire lid portion 20 when the body of the deceased is being placed into the casket.

The vehicle shaped casket 10 depicted in FIGS. 1–3 depicts a reflection of the features of the 1967 Mustang. The vehicle shaped casket can be designed to reflect the authentic features, including the very lines, curves and recognizable styling, of any automobile. The urns (not shown) are sculpted into the very shape of the automobiles using cast acrylic molds. The caskets and urns may be manufactured from any suitable material. A particularly suitable material is fiberglass, which is lightweight and easily molded, but hardwoods and metals including, but not limited to, stainless steel and bronze, are also suitable. The interior of the body retaining compartment 50, the interior surface 52 of the hood section 25 and the interior surface 54 of the roof section are lined with a decorative cushion material.

It is to be understood that the present invention is not limited to the embodiments described above, but encompasses any and all embodiments within the scope of the following claims.

I claim:

1. A vehicle shaped funeral container comprising:

a body portion configured to authentically reflect the features of the chassis of an automobile, the body portion having a front end, a rear end and a pair of sides;

a lid portion, pivotally connected along one of the pair of sides of the body portion, the lid portion being configured to authentically reflect the top portion of the automobile, the lid portion having a front hood section and a rear raised roof section defining a passenger portion of the automobile;

a mounting base member positioned underneath said body portion, said body portion and said lid portion being supported on said base member, the base member having a front end, a rear end and a pair of said surfaces;

a name display member disposed on a front side of said base member;

a plurality of gripping rails disposed along said base member, said plurality of gripping rails comprising a front, rod shaped, elongate, gripping rail disposed along the front end of the base member, a rear, rod shaped, elongate gripping rail disposed along the rear end of the base member and a pair of side, rod shaped elongate gripping rails, each side rail disposed along one of the pair of side surfaces of said base member;

a plurality of authentic vehicle identification members disposed on said base member and said body portion;

a body retaining compartment located inside of said body portion;

a plurality of hinge members disposed along one of said pair of the pair of sides of said body portion, the hinge members pivotally connecting said lid portion to said body portion so that the front hood section and the rear roof section may be pivoted from a closed position to an open position individually or simulataneously;

a pair of side windows disposed along the sides of the raised roof portion, the windows reflecting the authentic features of the automobile;

a front windshield disposed along the front surface of the raised roof portion, the windshield reflecting the authentic features of the automobile;

a trunk portion defined along the rear end of the body portion, the trunk portion reflecting the authentic features of the automobile;

said body portion having the authentic features of headlights, a front bumper, a rear bumper, a plurality of doors and a plurality of fenders particular to the automobile; and a lifting lip disposed at a junction of said lid portion and said body portion for allowing lifting of said lid portion in order to allow access to said body retaining compartment;

whereby a portion of said lid portion is pivoted about said hinge members to allow access to said body retaining compartment.

2. The vehicle shaped funeral container according to claim 1, wherein said authentic vehicle identification members are selected from the group consisting of authentic nameplates and authentic hood ornaments.

3. The vehicle shaped funeral container according to claim 1, wherein the funeral container is dimensioned and configured as a casket, the body portion being adapted for receiving a deceased human being's body before cremation.

4. The vehicle shaped funeral container according to claim 1, wherein the funeral container is dimensioned and configured as an urn, the body portion being adapted for receiving a deceased human being's remains after cremation.

5. The vehicle shaped funeral container according to claim 1, wherein said body portion, said lid portion, and said base member are made from a material selected from the group consisting of fiberglass, hardwoods and metals.

* * * * *